United States Patent [19]

Reynolds

[11] Patent Number: 4,994,863

[45] Date of Patent: Feb. 19, 1991

[54] ELECTROSTATIC SCAVENGER HAVING MAGNETIC DRIVE DISK

[75] Inventor: Timothy W. Reynolds, Rochester, N.Y.

[73] Assignee: Eastman Kodak Company, Rochester, N.Y.

[21] Appl. No.: 451,661

[22] Filed: Dec. 18, 1989

[51] Int. Cl.[5] ..... G03G 21/00

[52] U.S. Cl. ..... 355/303; 355/296

[58] Field of Search ..... 355/245, 251, 252, 253, 355/269, 296, 303, 305; 118/652, 656, 657, 658

[56] References Cited

U.S. PATENT DOCUMENTS

| | | | |
|---|---|---|---|
| 3,457,900 | 7/1969 | Drexler | 118/637 |
| 3,543,720 | 12/1970 | Drexler | 118/637 |
| 3,659,311 | 5/1972 | Waren | 15/256.5 |
| 4,043,298 | 8/1977 | Swackhamer | 118/652 |
| 4,466,728 | 8/1984 | Schlageter et al. | 355/215 |
| 4,482,244 | 11/1984 | Yamazaki et al. | 118/652 X |
| 4,671,641 | 6/1987 | Kohyama | 355/251 |
| 4,674,865 | 6/1987 | Tada et al. | 118/652 X |

FOREIGN PATENT DOCUMENTS

| | | | |
|---|---|---|---|
| 0149340 | 12/1978 | Japan | 355/305 |
| 0113073 | 9/1980 | Japan | 355/251 |
| 0219583 | 12/1983 | Japan | 355/303 |

*Primary Examiner*—Arthur T. Grimley
*Assistant Examiner*—Nestor R. Ramirez
*Attorney, Agent, or Firm*—Tallam I. Nguti

[57] ABSTRACT

An electrostatic scavenger roller within the development apparatus of an electrostatographic copier or printer for recovering unwanted charged carrier particles (DPU) from the image-bearing surface of such copier or printer after development. The scavenger roller, which is mounted rotatably adjacent the image-bearing surface and within reach of first magnetic fields on the alternating pole magnets of a rotatable development roller, includes a magnetic drive disk at each end thereof. Each of the magnetic drive disks consists of a series of alternating pole magnets fixedly disposed inside the scavenger roller for rotation therewith, and each generates a second magnetic field which overlaps the first magnetic fields of the development roller. As such, rotation of the development roller magnetically induces rotation of the magnetic disks and, hence, rotation of the scavenger roller, thereby bringing the electrostatically recovered carrier particles (DPU) thereon, around and into the first magnetic fields for magnetic recapture by the magnetic development roller.

2 Claims, 2 Drawing Sheets

ELECTROSTATIC SCAVENGER HAVING MAGNETIC DRIVE DISK

BACKGROUND OF THE INVENTION

This invention relates to scavenging devices within a development apparatus of electrostatographic copiers and printers for recovering unwanted charged carrier particles (DPU) from the image-bearing surface of each such copier or printer. More particularly, the invention relates to such a scavenging device that is electrostatically biased, and which is simple, effective and relatively less expensive to operate.

The use of development material consisting of charged carrier particles and charged toner particles for toner particle development of latent electrostatic images in electrostatographic copiers and printers is well known. During such development, the charged toner particles, but not the charged carrier particles, are expected to be attracted to the electrostatic latent images thereby developing them. One well known problem associated with such image development involves some carrier particles (DPU) that unwontedly are attracted along with the toner particles to the image-bearing surface of the copier or printer.

The use of various types of scavenging devices for recovering such unwanted carrier particles (DPU) from the image-bearing surface is also well known. For example, rotatable magnetic scavenging devices are disclosed in U.S. Pat. No. 3,457,900, issued July 29, 1969 to R. A. Drexler, and U.S. Pat. No. 4,466,728, issued Aug. 21, 1984 to Schlageter et al. Typically, such conventional scavenging devices require and include several other components, particularly a separate means for driving the roller therein in order to operate effectively. As such, they are relatively expensive, and in addition, their effectiveness can be affected by the failure of any such required additional components.

SUMMARY OF THE INVENTION

It is an object of the present invention to provide a simple, effective and relatively less expensive scavenging device within an electrostatographic development apparatus for recovering unwanted charged carrier particles (DPU) from the image-bearing surface of a copier or printer.

In accordance with the present invention, a development apparatus in an electrostatographic copier or printer includes: (a) a magnetic development roller for developing electrostatic latent images on an image-bearing surface using charged toner particles contained in development material consisting of such toner particles and of oppositely charged magnetic carrier particles; and (b) a scavenging device for recovering unwanted carrier particles (DPU) transferring to the image-bearing surface during toner development of the electrostatic images thereon.

The scavenging device of the present invention includes a non-magnetic scavenger roller mounted rotatably adjacent the image-bearing surface, and within the reach of first magnetic fields being generated by a series of longitudinally extending alternating pole magnets of the rotatable development roller. The scavenging device also includes a source of electrical potential connected to the non-magnetic scavenger roller for biasing such roller to a polarity opposite that of the charged carrier particles so as to cause the scavenger roller to electrostatically recover such particles from the image-bearing surface onto the scavenger roller. The scavenging device further includes a pair of magnetic drive disks fixedly disposed inside the scavenger roller at each end thereof for rotation therewith. Each drive disk consists of a series of radially arranged, alternating pole magnets, each generating a second magnetic field that overlaps the first magnetic fields of the development roller. As such, rotation of the development roller magnetically induces rotation of the magnetic disks and, hence, rotation of the scavenger roller, thereby bringing the electrostatically recovered carrier particles (DPU) thereon around into the reach of the first magnetic fields for magnetic recapture by the magnetic development roller.

BRIEF DESCRIPTION OF THE DRAWINGS

In the detailed description of the invention below, reference is made to the drawings, in which.

DETAILED DESCRIPTION OF THE INVENTION

Figure 1:
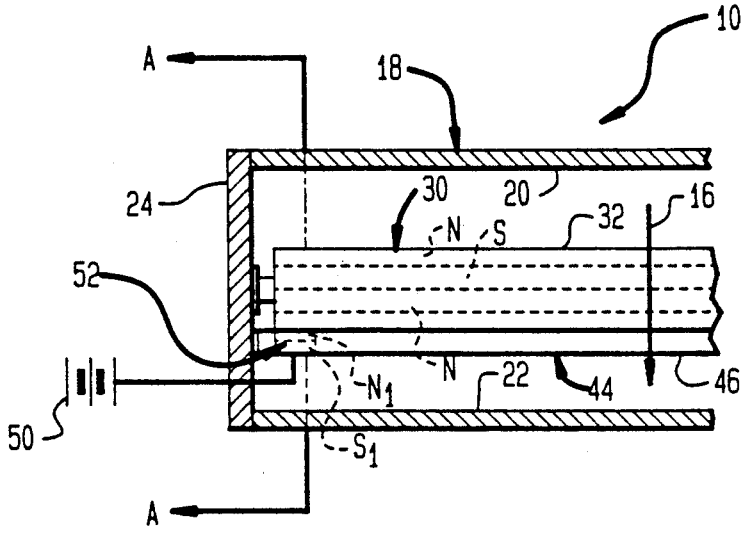
FIG. 1 is a top view, partly in section, of one end of the development apparatus of the present invention showing one end of the scavenging device of the present invention.
Figure 2:
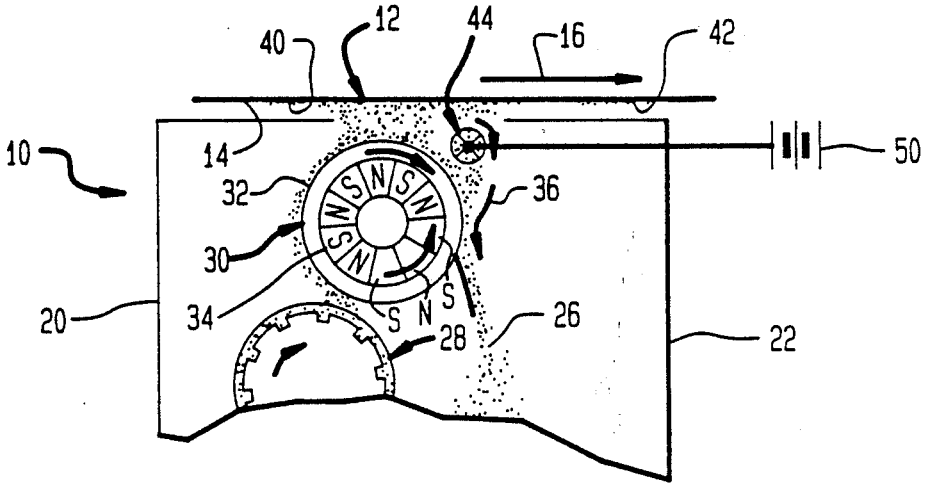
FIG. 2 is a schematic illustration of the end view of the development apparatus of FIG. 1 taken along the cutting plane A—A.
Figure 3A:
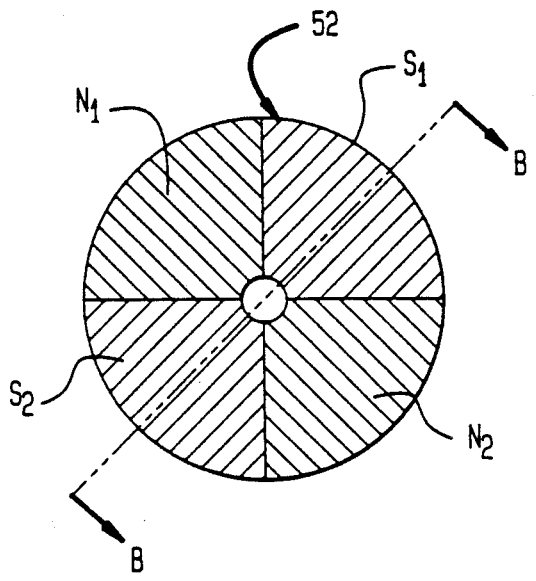
FIG. 3A is an enlarged section of the magnetic drive disk as viewed in FIG. 2.
Figure 3B:
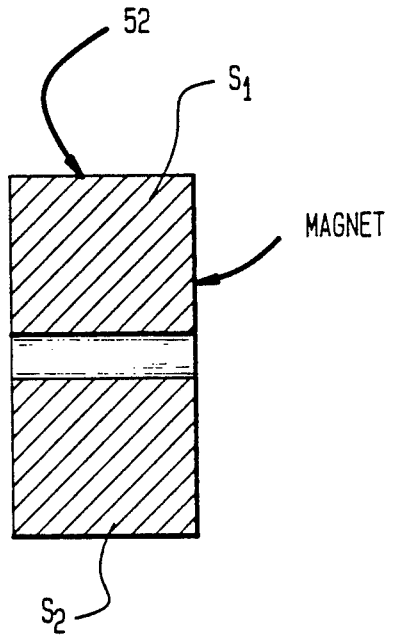
FIG. 3B is a section of the magnetic drive disk of FIG. 3A taken along the cutting plane B—B.

Referring now to the drawings, FIGS. 1 and 2 show two views of a development apparatus generally designated, 10 in an electrostatographic copier or printer. The development apparatus 10, as is well known, is mounted in such copier or printer adjacent an image-bearing member 12 that has an image-bearing surface 14 on which images are formed electrostatically, as is also well known. The image-bearing member 12 is shown traveling in the direction of arrow 16 past the development apparatus 10.

The development apparatus 10, of which only one end is shown in FIG. 1, and only the top portion is shown in FIG. 2, includes a housing 18 with side walls 20, 22 and an end wall 24. The other end wall is of course not shown. The apparatus 10, which includes a sump portion (not shown) of the housing 18 for holding and mixing developer material 26, also includes a feed roller 28 and a magnetic development roller 30. The development roller 30 can be a conventional magnetic development roller consisting of a rotatable non-magnetic shell 32 and a rotatable magnetic core 34. The core 34, as shown, further can consists of a series of longitudinally extending, alternating pole magnets, each generating a first magnetic field about and beyond the non-magnetic shell 32. The shell 32 and core 34 can be driven rotatably by suitable means (not shown) in the directions of the indicating arrows so as to cause developer material 26 thereon to move in the direction of arrow 36, for example.

The developer material 26, which consists of charged magnetic carrier and toner particles, is appropriately charged within the bottom portion of the apparatus 10, and is then fed by means, including the feed roller 28, onto the surface of the development roller 30. The development roller 30 then moves the developer into toner applying relationship with latent electrostatic images 40 on the image-bearing surface 14. The charged toner particles in the developer material on the roller 30 are then attracted to the surface 14 as expected, developing the latent images 40 and forming developed or toner images 42.

Some carrier particles (DPU), however undesirably also transfer to the surface 14 during such development with toner particles. Such unwanted carrier particles (DPU) will cause image defects on copies produced by the copier or printer, if such carrier particles (DPU) are not recovered from the surface 14 prior to the transfer of the toner images 42 onto a suitable copy sheet or receiver for fusing.

For recovering such unwanted carrier particles, the development apparatus 10 accordingly includes a scavenging device 44 which, as shown, is mounted adjacent the image-bearing surface 14 just downstream of the point of development (as described above) of the images 40 on such surface. The scavenging device 44 includes a non-magnetic scavenger roller 46 that is mounted rotatably at each end to the end walls, including wall 24. The roller 46 is mounted so as to be spaced only a small distance from the surface 14, and so as to be within the reach of the first magnetic fields of the magnets of the core 34 of development roller 30.

The scavenging device 44 also includes a source 50 of electrical potential that is connected to the scavenger roller 46 for electrically biasing such roller to a polarity opposite that of the charged magnetic carriers. Such biasing causes the unwanted carrier particles (DPU) on the image-bearing surface 14 to be recovered therefrom by being electrostatically attracted onto the surface of the scavenger roller 46 as the surface 14 moves past such roller 46. Such biasing of the scavenger roller 46 should however be such as to allow magnetic recapture, for example by the magnetic development roller 30, of the recovered charged magnetic carrier particles (DPU) therefrom.

In order to prevent the recovered carrier particles (DPU) from detrimentally accumulating on the scavenger roller 46 directly against the image-bearing surface 14, the scavenging device 44 further includes a pair of magnetic drive disks 52. Each disk 52 is disposed fixedly and coaxially inside the scavenger roller 46 near each end thereof for rotation therewith. Each disk 52 consists of a series of circumferentially arranged alternating pole magnets, for example, $N_1$, $S_1$, $N_2$, $S_2$, each generating a second magnet field that overlaps the first magnetic fields of the development roller core 34. As such, these first and second overlapping magnetic fields form a magnetic coupling at each such end through which rotation of the core 34 of the development roller 30 also magnetically induces rotation of the disks 52 and, hence, rotation of the scavenger roller 46.

Such rotation of the scavenger roller 46 operates to bring the electrostatically recovered magnetic carrier particles (DPU) thereon, around as shown, and into the reach of the first magnetic fields of the development roller core 34. There, such magnetic particles are then magnetically recaptured by the stronger magnetic effect of development roller.

A skive device 54 in contact with the surface of the non-magnetic shell 32 of the development roller 30 can thereafter operate to remove all such carrier particles, as well as, the spent developer material 26 thereon, for return to the bottom portion of the apparatus 10 where it can be remixed and recharged for subsequent use as above.

As can be seen, the scavenging device of the development apparatus of the present invention is effective, simple in design and in operation, and relatively less expensive, especially since it requires no independent or separate drive means for such effective operation.

Although the invention has been described with reference to a particular embodiment, it is understood that modifications and variations thereof can be effected within the scope and spirit of the invention as a whole.

I claim:

1. In an electrostatographic copier or printer, a development apparatus for developing electrostatic latent images on an image-bearing surface with charged toner particles contained in developer material consisting of charged magnetic carrier particles and such toner particles, the development apparatus including:

(a) a housing positioned adjacent the image-bearing surface and including a sump portion for holding a supply of developer material, and a top portion having an opening therein;

(b) a magnetic development roller located in said top portion across said opening therein for moving developer material across said opening and into developer applying relationship with the electrostatic latent images on the image-bearing surface thereby developing such images with toner particles in the developer material, said magnetic roller including a rotatable magnetic core consisting of a series of longitudinally extending, alternating pole magnets each generating a first magnetic field reaching beyond said development roller;

(c) means for feeding developer material from said sump portion to said development roller; and (d) a scavenging device for recovering charged magnetic carrier particles (DPU), having a known polarity, and undesirably transferring from said development roller to the image-bearing surface during such image development with toner particles, said scavenging device comprising:

(i) a rotatable, non-magnetic scavenger roller mounted adjacent the image-bearing surface and within the reach of said first magnetic fields;

(ii) first and second magnetic disks mounted fixedly and coaxially within said scavenger roller near each end thereof for rotation therewith, each said first and second disk consisting of a series of circumferentially arranged, alternating pole magnets each generating a second magnetic field overlapping said first magnetic fields; and (iii) an electrical potential source connected to said scavenger roller for biasing said roller to a polarity opposite that of the charged magnetic carrier particles.

2. A scavenging device in a development apparatus of an electrostatographic copier or printer for recovering charged magnetic carrier particles, having a known polarity, from the image-bearing surface of such copier or printer and returning such particles to a magnetic development roller therein including a rotatable magnetic core consisting of a series of longitudinally extending, alternating pole magnets each generating a first magnetic field reaching beyond said development roller, the scavenging device comprising:

(a) a rotatable, non-magnetic scavenger roller mounted adjacent the image-bearing surface within the reach of said first magnetic fields;

(b) an electrical potential source connected to said scavenger roller for biasing said roller to a polarity opposite that of the charged magnetic carrier particles; and (c) magnetic means responsive to movement of said first magnetic fields, said magnetic means being associated and rotatable with said scavenger roller for magnetically rotating said scavenger roller responsively to movement of said first magnetic fields, and said magnetic means including first and second magnetic disks mounted fixedly and coaxially within said scavenger roller near each end thereof for rotation therewith, each said first and second disk consisting of a series of circumferentially arranged, alternating pole magnets each generating a second magnetic field overlapping said first magnetic fields.

* * * * *